United States Patent [19]

Ikeda

[11] Patent Number: 4,800,629

[45] Date of Patent: Jan. 31, 1989

[54] PLASTIC BUCKLE

[75] Inventor: Yasuhiko Ikeda, Yokohama, Japan

[73] Assignee: Nifco Inc., Yokohama, Japan

[21] Appl. No.: 136,765

[22] Filed: Dec. 22, 1987

[30] Foreign Application Priority Data

Dec. 25, 1986 [JP] Japan ..... 61-308018

[51] Int. Cl.[4] ..... A44B 11/00

[52] U.S. Cl. ..... 24/170; 24/200; 297/479; 297/483

[58] Field of Search ..... 24/170, 200, 68 CD, 24/575, 625; 297/483, 479

[56] References Cited

U.S. PATENT DOCUMENTS

| | | | |
|---|---|---|---|
| 416,985 | 12/1889 | Beattie | 24/170 |
| 1,718,274 | 6/1929 | Carlson | 24/170 |
| 2,903,774 | 9/1959 | Harley | 24/170 |
| 4,395,803 | 8/1983 | Krauss | 24/200 |
| 4,493,135 | 1/1985 | Crook, Jr. | 24/200 |
| 4,502,188 | 3/1985 | Kohli | 24/170 |
| 4,542,630 | 9/1985 | Nanasi et al. | 24/170 |
| 4,577,377 | 3/1986 | Kasai | 24/625 |

FOREIGN PATENT DOCUMENTS

| | | | |
|---|---|---|---|
| 54-144244 | 10/1979 | Japan . | |
| 2169027 | 7/1986 | United Kingdom | 24/200 |

*Primary Examiner*—Victor N. Sakran

*Attorney, Agent, or Firm*—Oblon, Fisher, Spivak, McClelland & Maier

[57] ABSTRACT

A very safe buckle, formed of plastic, is provided which enables a strap to be inserted and clamped easily and quickly, and which prevents the strap from being inadvertently loosened or pulled free of the buckle no matter how the strap or the buckle is pulled about. The buckle is comprised of two adjacent bars spanning the space between the sides of the buckle. The strap is passed between the two bars. One of the bars is rotatable and has a polygonal cross-section, the arrangement being such that the rotation of the rotatable bar reduces the size of the gap between the rotatable bar and the other bar, which is fixed, thereby clamping the strap securely between the bars.

3 Claims, 5 Drawing Sheets

PLASTIC BUCKLE

BACKGROUND OF THE INVENTION

1. Field of the Invention

This invention relates to a plastic buckle provided with a means for adjusting the length of a strap of suitcases or harnesses or the like.

2. Prior Art Statement

Such a plastic buckle as described above provided with means to adjust the length of a strap has been disclosed in Japanese Patent Public Disclosure No. SHO 54(1979)-144244. Describing this known buckle with reference to FIG. 12, the buckle 1 is provided on the inner surfaces of two side members 2 with an upper bar 3 and a lower bar 4 which are offset relative to each other and which have respective angled portions 5, 6 spaced away from each other by a distance that is smaller than the thickness of a strap B.

With this conventional buckle 1, attaching the strap B was extremely troublesome. Specifically, attaching the strap B required that it be inserted in the space between the bars 3 and 4. However, the opposed angled portions 5, 6 of the bars 3 and 4 narrowed the space, which made it very difficult to insert the strap B and severely limited the direction in which it could be inserted.

The conventional buckle 1 also has the defect that, if the strap B or the buckle itself is pulled in a wrong direction, the strap B is loosened and readily slips out. The strap B does not become loose and slip out while the strap B and the buckle 1 are maintained more or less horizontally, but pulling the trailing end portion of the strap B directly downward (i.e., in the direction indicated by b in FIG. 12) or lifting up the buckle itself extends the strap B in a straight line between the bars 3 and 4, which is a state in which the strap B can readily slip out.

When the conventional buckle is used on the seat strap of baby carriage, for example, because the strap cannot be tightened against the body of the infant the belt is often fastened with a certain amount of slackness. Because of this, the infant playing with the buckle and the movement of the infant's body pulling the strap in all directions can change the angle formed by the strap and the buckle, leading to further loosening of the strap and, in extreme cases, even to the strap becoming completely unbuckled, which is undesirable from the viewpoint of safety.

OBJECT AND SUMMARY OF THE INVENTION

The object of this invention is to provide a very safe buckle which enables a strap to be fitted with ease and whereby the strap does not become loose or slip out of the buckle when the strap or the buckle is pulled carelessly.

To achieve this objective, the plastic buckle according to this invention is comprised of two adjacent bars provided between two opposed side members, the ends of one of the bars being supported so as to be rotatable relative to the side members, the arrangement being such that the rotation of the rotatable bar reduces the space between the rotatable bar and the other, fixed, bar to less than the thickness of the strap.

With the buckle of the aforementioned structure, because the space formed by the two bars into which the strap is inserted is not made narrower prior to the insertion, the insertion of the strap is facilitated. Also, even if the leading end of the strap should contact the rotatable bar, it does not result in any hindrance to the insertion because of the ability of the bar to rotate freely.

After the strap has been inserted between the two bars of the buckle, pulling the strap horizontally rotates the rotatable bar counterclockwise (with reference to the drawings). With this rotation, the space between the two bars will gradually become smaller until the rotation of the rotatable bar stops at a position where it is clamping the strap from below in a position of engagement with an abutment portion of the fixed bar. In this stop position the strap is clamped from both sides by the bars, preventing the strap from coming free of the buckle.

The above and other objects and features of the invention will become more apparent from the following detailed description with reference to the accompanying drawings.

BRIEF DESCRIPTION OF THE DRAWINGS

FIG. an exp perspective drawing of a first embodiment of a buckle according to this invention.

DETAILED DESCRIPTION OF THE PREFERRED EMBODIMENTS

Figure 1:
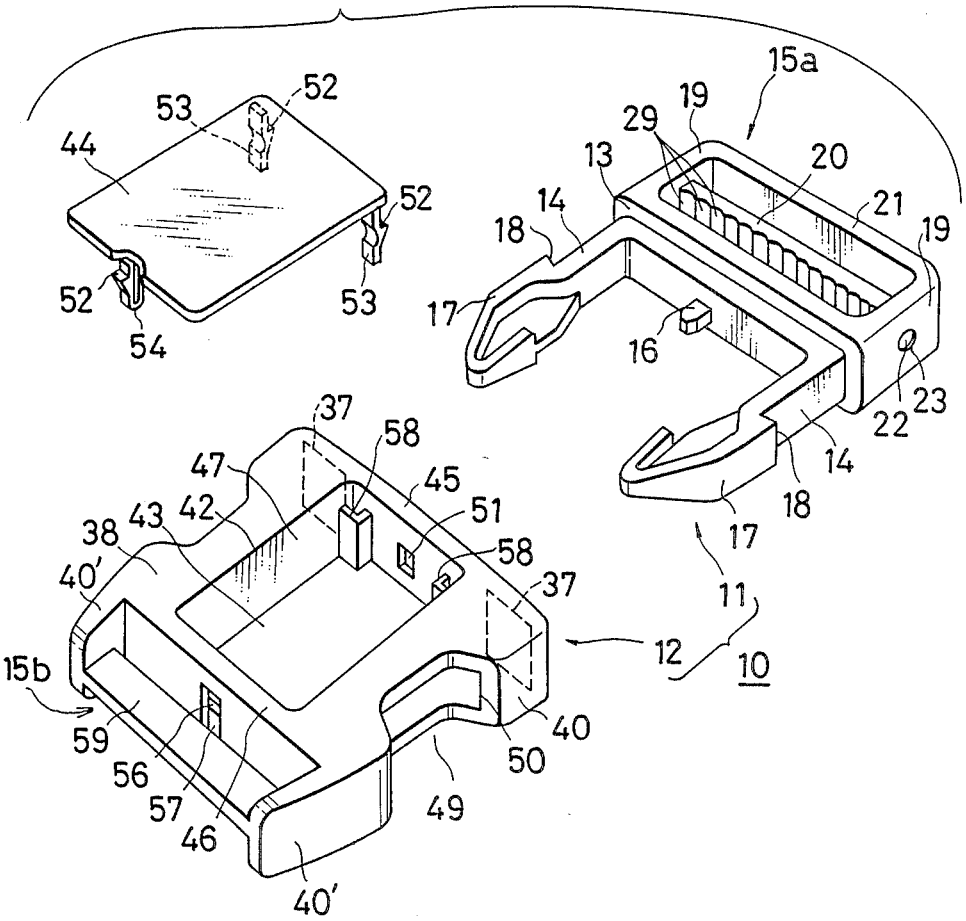

FIGS. 1 to 8 illustrate a first embodiment of a plastic buckle according to this invention. A buckle 10 is comprised of a male member 11 and a female member 12 which are mutually detachable.

As shown in FIGS. 1 to 4 and FIG. 6, the male member 11 is formed integrally of plastic and is provided with a stepped portion 13, a pair of flexible arms 14 extending forward on the right and left from the sides of the front surface of the stepped portion 13, and a U-shaped strap fixing portion 15*a* that extends back from the rear surface of the stepped portion 13. A short protuberance 16 is formed integrally in approximately the center of the front surface of the stepped portion 13 for positioning purposes. The free ends of the flexible arms 14 are provided with barb-shaped jamb portions 17 splayed out to the sides, and the rear edge of each of the jamb portions 17 is provided with angled latch portions 18 that slant backwards.

As shown in FIGS. 1 to 4 and FIGS. 7 and 8, the strap fixing portion 15*a* is comprised of a pair of opposed parallel side members 19 extending backwards from the right and left sides of the rear surface of the stepped portion 13, and two adjacent polygonal bars 20, 21 that bridge the space between the side members 19. The ends of one of the polygonal bars 20, 21 (in this embodiment, the inner bar 20) are supported so as to be rotatable relative to the side members 19.

Figure 3:
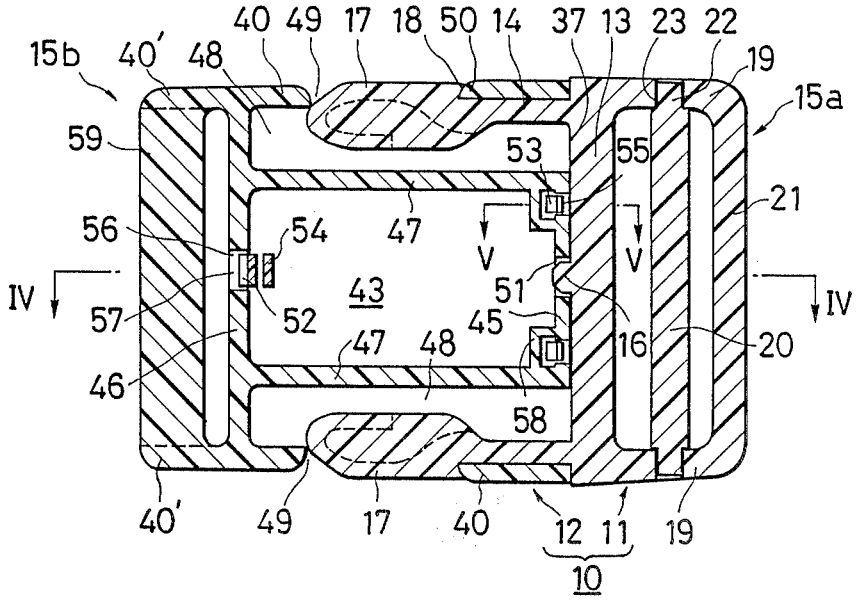
FIG. 3 a cross-sectional view of the buckle in a buckled state.

Describing the embodiment in more detail, with reference to FIG. 3, a shaft 22 extends from each end of the above-mentioned rotatable bar 20 and fits into a shaft hole 23 formed in each of the side members 19. The shafts 22 and shaft holes 23 may be formed by the shafts 22 being punched out from the shaft holes 23.

Figure 7:
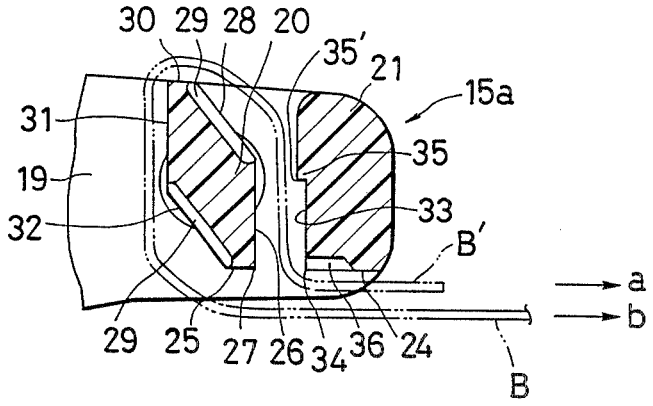
FIG. 7 is an expanded cross-sectional view of the principal portions of the male member of the buckle shown in FIG. 1.

With reference to FIG. 7, the rotatable bar 20 has a non-regular hexagonal cross-section approximating to a rhombus-shaped cross-section. It may of course just have a square cross-section or the like, as long as the cross-section is not round. The rotatable bar 20 of this embodiment is provided with a narrow 1st surface 25 that is roughly parallel to the bottom surface 24 of the fixed bar 21, and a 2nd surface 26 that rises at an acute angle, (for example, roughly perpendicularly) from the 1st surface 25, with an angle portion 27 being formed between the surfaces 25 and 26. The rotatable bar 20 is also provided with a 3rd surface 28 that adjoins the 2nd surface 26, from which it extends upwards at an oblique angle of, for example, 140 degrees. The 3rd surface 28 has a plurality of grooves 29 along the length direction of the rotatable bar 20, the grooves 29 preventing lateral movement of the strap B. A 4th surface 30, 5th surface 31, and 6th surface 32 are symmetrically arranged with respect to the axes of the 1st to 3rd surfaces described above, so the description thereof is omitted.

With reference to FIG. 7, the ends of the fixed bar 21 are attached to the inner surfaces of the side members 19, and the fixed bar 21 is provided with the abovementioned flat bottom surface 24, and a vertical surface 33 that rises at an acute angle from the bottom surface 24, (for example, roughly perpendicularly). A fixed angle portion 34 is formed between the surfaces 24 and 33 opposite the angle portion 27 of the rotatable bar 20. The vertical surface 33 is in parallel opposition to the 2nd surface 26 of the rotatable bar 20 in its at-rest state, with the space between the surfaces 26 and 33 being sufficiently larger than the thickness of the strap B.

Figure 8:
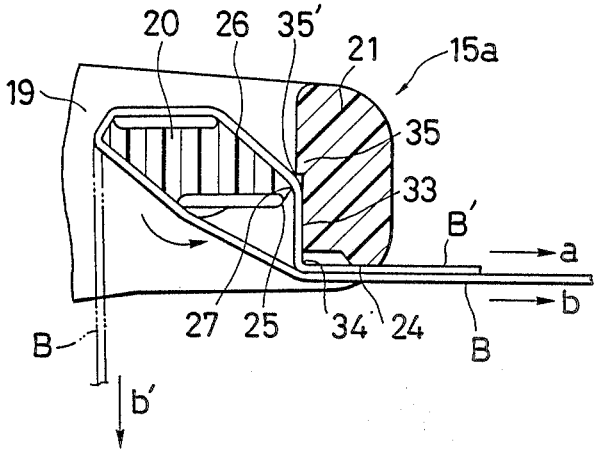
FIG. 8 is an expanded cross-sectional view of the principal portions of the male member of the buckle shown in FIG. 1 with inserted therethrough.

Still with reference to FIG. 7, the vertical surface 33 is provided midway up its height with an abutment portion 35 that regulates the angle of rotation of the rotatable bar 20. The abutment portion 35 is provided with a downward-facing lower surface that contacts the 2nd surface 26 when the rotatable bar 20 is rotated counterclockwise and that stops the counterclockwise rotation of the rotatable bar 20, as shown in FIG. 8.

Figure 6:
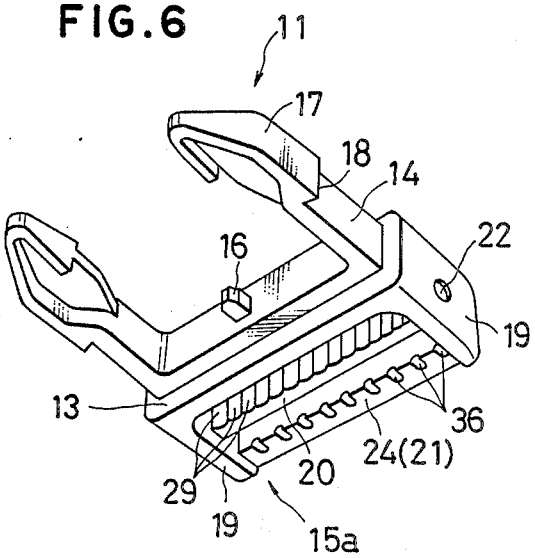
FIG. 6 a perspective view from below of the male member of buckle shown in FIG. 1.

The bottom surface 24 of the fixed bar 21 has a plurality of grooves 36 along the length direction of the rotatable bar 20, as shown in FIG. 6, the grooves 36 preventing lateral movement of the strap B.

As shown in FIGS. 1 to 5, the female member 12 is integrally formed of plastic and provided with: openings 37 at at least one end thereof to permit the insertion therein of the flexible arms 14 of the male member 11 by utilizing the resilience of the flexible arms 14 to flex the arms inward; a flat, hollow, tubular body casing 41 (see FIG. 2) enclosed on four sides by wide upper walls 38 and lower walls 39 and narrow side walls 40; a U-shaped strap fixing portion 15*b* extending backwards from the rear end of the body casing 41. The interior of the body casing 41 is provided with a containment portion 43 having an opening portion 42 in either the upper wall 38 or the lower wall 39 (in the upper wall 38 in this embodiment). The opening portion 42 of the containment portion 43 is openably closed by a lid 44. In the embodiment shown here, the lid 44 is formed of plastic separately from the female member 12. However, the lid 44 and the female member 12 may be formed of plastic integrally and joined by a thin hinge.

Figure 2:
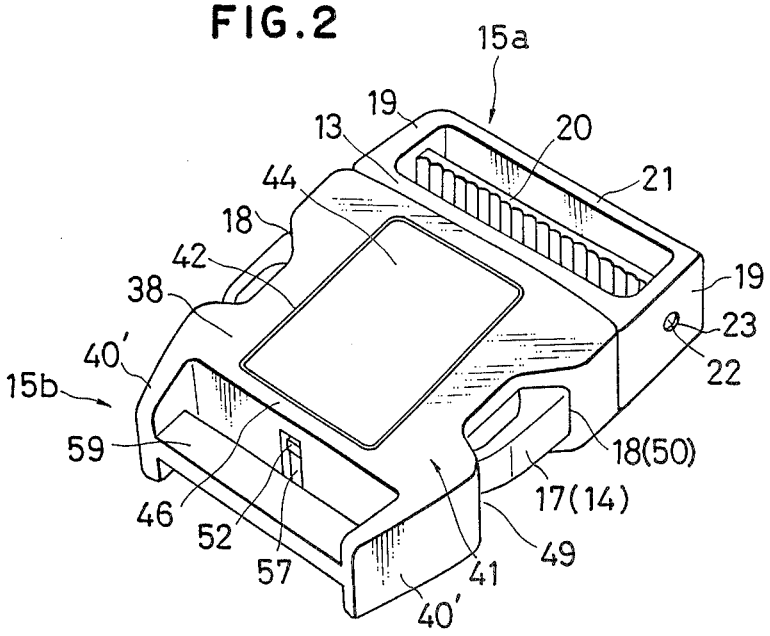
FIG. 2 is a perspective drawing of the buckle of FIG. 1 in a state.

The embodiment will now be described in more detail. As shown in FIGS. 1 to 3, the body casing 41 is provided with the upper and lower walls 38 and 39 and the side walls 40, and in addition the front surface thereof is closed by a front wall 45, except for the openings 37 provided at the sides, and the rear surface is closed by a rear wall 46, providing total enclosure. The interior of the body casing 41 is provided with inner walls 47 opposite to the side walls 40 and spaced therefrom by a distance equal to the width of the openings 37. The spaces between the inner walls 47 and the side walls 40, as shown in FIG. 3, form long, narrow passages 48 that extend back from the openings 37 at one end and along which the flexible arms 14 of the male member 11 pass. The space between the inner walls 47 is formed into the containment portion 43 by the front wall 45, rear wall 46, and the inner walls 47, the containment portion 43 being closed off at its lower surface by the lower wall 39 and having a large opening portion 42 in the upper wall 38.

The side walls 40 are provided with openings 49 in the passages 48 in which fit the jamb portions 17 of the flexible arms 14 of the male member 11. The openings 49 include a cutout portion of the upper and lower walls 38 and 39, and the rear edge of each of the openings 49 has been formed into engagement portion 50 that has been given the same angle as the latch portions, 18 on the jamb portion 17 of the corresponding flexible arm 14 so that they hook into engagement with the latch portions 18.

The front wall 45 is also provided at its center with a small square through-hole 51 with which the protuberance 16 projecting from the stepped portion 13 of the male member 11 engages.

Figure 4:
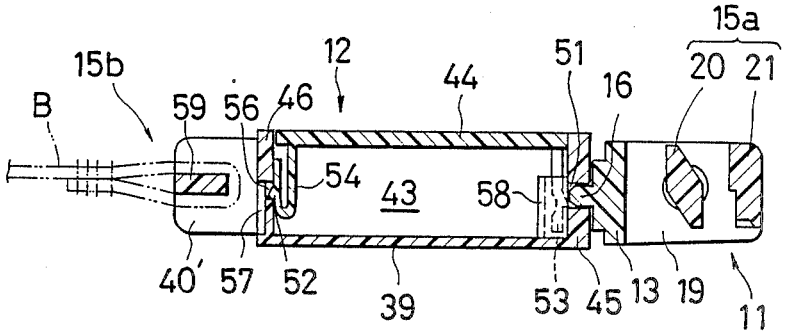
FIG. 4 is a cross-sectional view along the line IV—IV of FIG. 3
Figure 5:
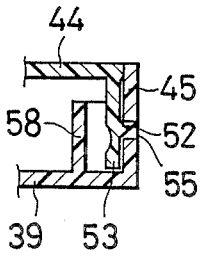
FIG. 5 is a cross-sectional view along the line V—V of FIG. 3.

As shown in FIGS. 3 to 5, a releasable engagement means is provided between the containment portion 43 and the lid 44 for engagement of the lid 44 with the opening portion 42 of the containment portion 43. The engaging means comprises resilient engaging members 53 and 54 provided perpendicularly from the lid 44 and each possessing a ratchet-shaped claw 52 and engaging holes 55 and 56 provided on the inner walls of the containment portion 43 into which the claws 52 engage. In addition, the lid 44 may be provided with a stepped engagement portion and a projection provided on the inner wall of the containment portion 43 that hooks into engagement with the stepped engagement portion.

A pair of the resilient engaging members 53 are provided at the front end of the lid 44 and one resilient engaging member 54 is provided at the center of the rear end thereof. The former extend in a more or less straight line and midway along their length are provided with forward-facing claws 52, while the latter is curved back into a J-shape the end of which is provided with a backward-facing claw 52. The engaging holes 55 and 56 are formed horizontally at both sides of the front wall 45 and at the center of the rear wall 46, the latter forming a through-hole in the rear wall 46 the edge of which is provided with a shallow groove 57. Preferably, the corners of the containment portion 43 are provided with L-shaped guide walls 58 into which are guided the resilient engaging members 53 as they approach the engaging holes 55.

The strap fixing portion **15*b* of the female member 12 is extremely simple in construction compared with the strap fixing portion 15*a* of the male member 11, consisting of a rearward extension 40 of each side walls 40 and a strip-shaped crosspiece 59 that has a thin vertical dimension provided between the extension portions 40'. The same construction as that of the strap fixing portion 15*a*** may of course be used.

The procedure of engaging the male member 11 and the female member 12 will now be described. The lid 44 for the opening portion 42 of the containment portion 43 is closed beforehand, and the strap B is attached to the strap fixing portions **15*a* and 15*b* of the male member 11 and female member 12**.

The opening portion 42 of the containment portion 43 may be closed by fitting the lid 44 onto the opening portion 42 with the resilient engaging members 53 and 54 of the lid 44 pointing inward. If the resilient engaging members 53 are fitted into the guide walls 58 and the lid 44 is pressed onto the opening portion 42, the resilient engaging members 53 and 54 flex and enter the containment portion 43, and with the claws 52 in a position of alignment with the engaging holes 55 and 56, the resiliency of the resilient engaging members 53 and 54 causes the claws 52 to snap into the engaging holes 55 and 56, retaining the lid 44 on the opening portion 42 of the containment portion 43.

Next, to attach the strap B to the strap fixing portion **15*a* of the male member 11, as shown by the dashed line in FIG. 7, the free end B' of the strap B is slid over the bottom surface 24 of the fixed bar 21 and threaded around the 1st surface 25, the 6th surface 32 and the 5th surface 31 of the rotatable bar 20 and pulled out at the top, then it is folded over and guided down into the space between the bars 20 and 21 and between the bottom surface 24 of the fixed bar 21** and the trailing end of the strap B, then back out to the exterior.

To tighten the strap B, the free end B' thereof is pulled in the direction indicated by a in FIG. 7. When the free end B' of the strap B is pulled, it moves across each of the surfaces of the bars 20 and 21. To loosen the strap B, the strap B is fed in the reverse direction to produce slack at the fold-over point above the rotatable bar 20, whereupon the strap B can be loosened merely by pulling the trailing end in the direction indicated by b in FIG. 7, so loosening of the strap B is simple.

Once the adjustment of the length of the strap B has been thus completed, the trailing end portion of the strap B may be pulled in the direction b of FIG. 7 to tighten the strap. That is, when the trailing end portion of the strap B is pulled back in direction b, the rotatable bar 20 is subjected to this pull and rotates counterclockwise about the shaft 22. With this rotation, the angle portion 27 of the rotatable bar 20 gradually approaches the fixed bar 21, narrowing the space between the rotatable bar 20 and the fixed bar 21 so that the 2nd surface 26 and the angle portion 27 of the rotatable bar 20 clamp the strap B up against the lower surface of the abutment portion 35 on the fixed bar 21, which stops the rotation (FIG. 8). In this stop position, the strap B is bent into a Z shape by the vertically opposed angle portion 27 of the rotatable bar 20 and the fixed angle portion 34 of the fixed bar 21. Because of this, even when force is applied in the direction in which the strap is withdrawn (direction b in FIG. 8), the strap B is wound in close contact with the angle portion 27 and the fixed angle portion 34, preventing the strap B from coming out.

Moreover, if a force is applied to the strap B in the direction along which it is withdrawn, it produces a rotational force that rotates the rotatable bar 20 counterclockwise and thereby causes the 2nd surface 26 and the angle portion 27 of the rotatable bar 20 to be pressed strongly towards the lower surface of the abutment portion 35, clamping the strap B therebetween from both sides, in addition to which the angle portion 27 of the rotatable bar 20 and an angle portion 35' of the abutment portion 35 dig into the strap B in a vertically offset relationship, preventing the strap B from slipping out. With respect to this effect, irrespective of the direction of the force applied to the trailing end portion of the strap B, even when the strap B is pulled directly downward (direction b' in FIG. 8), it will again produce a rotational force that rotates the rotatable bar 20 counterclockwise, preventing the strap B from slipping out. Moreover, the rotational force acting on the rotatable bar 20 depends on the friction between the rotatable bar 20 and the strap B and the sectional shape of the rotatable bar 20.

The strap B may be attached to the strap fixing portion **15*b* of the female member 12, as shown in FIG. 4, by folding the free end of the strap B around the crosspiece 59**, doubling up the leading end portion with the trailing end portion and stitching the thus overlapped portions of the strap.

With respect to the method of coupling the male member 11 and female member 12 together, the coupling may be accomplished by aligning the flexible arms 14 of the male member 11 with the openings 37 in the body casing 41 of the female member 12, as shown in FIG. 1. That is, upon the insertion of the flexible arms 14 of the male member 11, the outer face of the jamb portions 17 on the ends thereof contact the inner edge of the openings 37. When the flexible arms 14 are pushed against the edge of the openings 37, the flexible arms 14 are flexed inward from their base portions toward each other, thereby moving past the openings 37 and into the passages 48. When the jamb portions 17 of the flexible arms 14 reach the openings 49, the resilience thereof causes the jamb portions 17 to snap into the openings 49, at which point the latch portions 18 on the rear end of the jamb portions 17 engage with the engagement portions 50 on the rear edge of the openings 49, so that the flexible arms 14 are held in the passages 48 and cannot be withdrawn, whereby the male member 11 and the female member 12 are coupled together. At this point, the protuberance 16 on the male member 11 fits into the through-hole 51 in the front wall 45 of the female member 12, thereby minimizing play arising after the coupling has been carried out.

Disengagement of the male member 11 and female member 12 of the buckle is done by using fingers to simultaneously press the flexible arms 14 of the male member 11 in at the openings 49. That is, when the flexible arms 14 are pressed in thus, the arms are flexed toward each other, releasing the latch portions 18 of the jamb portions 17 from the engagement portions 50 of the openings 49. The resilience of the flexible arms 14 urges the flexible arms 14 to retract along the passages 48 toward the openings 37 and spring from the openings 37, enabling the male member 11 and female member 12 to be disengaged swiftly and easily.

To use the containment portion 43 of the female member 12, the lid 44 is removed, the item to be housed therein (not shown) is placed into the containment portion 43 and the lid 44 is put back on.

The lid 44 can be removed by pressing in the claw 52 of the resilient engaging member 54 from the outside via the engaging hole 56. A fingernail or a screwdriver can be used to push in the claw 52 projecting from the shallow groove 57, thereby flexing the J-shaped resilient engaging member 54 and removing the claw 52 from the engaging hole 56, enabling one end of the lid 44 to be lifted up by inserting a fingertip or nail into the space between the lid 44 and the opening portion 42, and by then disengaging the claws 52 of the resilient engaging members 53 from the engaging holes 55, the resilient engaging members 53 can be withdrawn from the guide walls 58 and the lid 44 removed.

Removing the lid 44 leaves the opening portion 42 of the containment portion 43 open, enabling a banknote or memo or the like that is folded small, or a special small memo notepad or the like to be placed in the containment portion 43, and the opening portion 42 is reclosed by putting the lid 44 back in position.

When attaching the strap B, if the lower wall 39 of the female member 12 is made to face outward, from the outside it will become impossible to see that there is a containment portion 43, as it will be shielded by the lower wall 39, enabling it to be utilized as a secret compartment.

The containment portion 43 also can be used as a space to incorporate a microswitch or light device. A microswitch (not shown), for example, could be incorporated so that the operating button thereof (not shown) is within the through-hole 51 of the front wall 45 so that it could be operated by pressing the protuberance 16 on the male member 11. If this arrangement were adopted, the engagement and disengagement of the male member 11 could be electrically detected, further expanding the field of application of the invention. If for example it were utilized for the buckle of a car seat belt, it could be arranged so that, at the point at which the handbrake is released, the driver would be given an audible warning if the seat belt was not buckled or not properly buckled, thereby promoting the proper use of seat belts.

Figure 9:
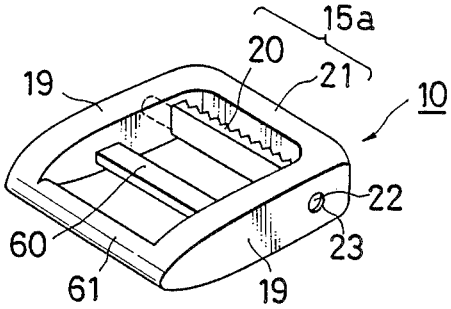
FIG. 9 is a perspective drawing of another embodiment of a buckle according to this invention.
Figure 10:
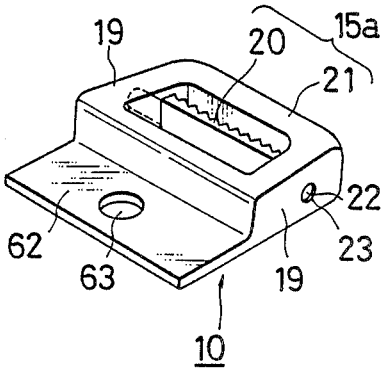
FIG. 10 is a perspective drawing of a further embodiment of a buckle according to this invention.
Figure 12:
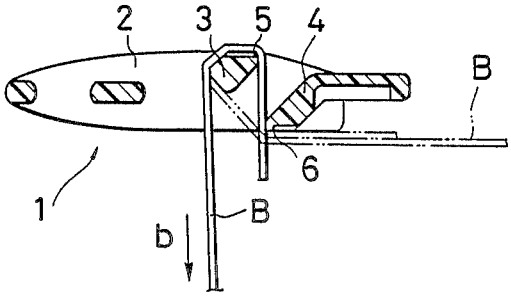
FIG. 12 PRIOR ART
FIG. 12 is a cross-sectional view of a conventional plastic buckle.

FIGS. 9 and 10 illustrate other embodiments of a buckle 10 provided with a strap fixing portion 15*a* that has the same construction as the strap fixing portion 15*a* of the male member 11 in the above embodiment.

Specifically, in the embodiment shown in FIG. 9, one end is provided with a strap fixing portion 15*a* that has side members 19, a rotatable bar 20 and a fixed bar 21, and provided rung-like between the other ends of the extended side members 19 are two parallel bars 60 and 61 arranged so that a strap B can be attached to both bars 60 and 61.

With reference to FIG. 10, the end portion of the strap fixing portion 15*a* is formed into a board-shaped attaching member 62. With this embodiment, a pin (not shown) is passed through a fixing hole 63 provided in the center part of the attaching member 62. The pin is passed through the fabric of, for example, a bag (not shown) and the end of the pin is caulked, for example, for direct attachment to the bag. Instead of using a pin the periphery of the attaching member 62 may be stitched directly onto the bag fabric.

Figure 11:
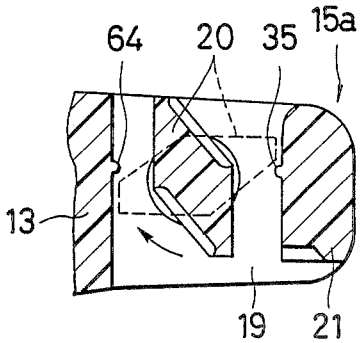
FIG. 11 is a cross-sectional view of a modification of the strap fixing portion in a buckle according to this invention.

FIG. 11 illustrates an example of a differently shaped strap fixing portion 15*a*. The inner side of the fixed bar 21 has a projecting abutment portion 35. In addition, there is also an abutment portion 64 that projects similarly from the rear face of the stepped portion 13. With this embodiment, the abutment portion 35 of the fixed bar 21 regulates counterclockwise rotation of the rotatable bar 20, and the abutment portion 64 of the stepped portion 13 regulates clockwise rotation of the rotatable bar 20, so that irrespective of the direction or orientation of pulling force applied to the strap B, movement in the length direction of the strap B is securely prevented.

Furthermore, although the containment portion 43 is shown as formed in the center of the body casing 41 of the female member 12, the body casing may instead be formed as separate upper and lower parts, with the space in the lower part being utilized to form a containment portion.

As has been described in the foregoing, this invention provides a highly safe buckle which enables a strap to be fixed in the strap fixing portion very quickly and easily, and ensures that, even if the strap or the buckle itself is pulled in a wrong direction, the strap does not become loose and slip out.

What is claimed is:

1. A plastic buckle comprising:

(a) a stationary bar and a rotatable bar provided adjacent to each other across a space between two opposed side members for fixing a strap inserted between said stationary bar and said rotatable bar;

(b) said stationary bar being fixed to said two opposed side members and having an abutment portion formed on an inner surface thereof facing said rotatable bar;

(c) said rotatable bar:

(i) having a peripheral surface which, in use, is surrounded once by said strap;

(ii) having a non-circular cross-section, (iii) being rotatably supported on said two opposed side members, and (iv) having two acute angle portions formed on edges of opposite sides thereof; and (d) one of said two acute angle portions being brought into abutment against said abutment portion of said stationary bar when a tension force is exerted on said strap to rotate said rotatable bar, thereby clamping said strap between said one acute angle portion and said abutment portion.

2. A plastic buckle according to claim 1 wherein said two acute angle portions are symmetrical relative to the axis of said rotatable bar.

3. A plastic buckle according to claim 2 wherein said rotatable bar has a rhombus-shaped cross-section.

* * * * *